US006998765B2

(12) United States Patent
Kim

(10) Patent No.: US 6,998,765 B2
(45) Date of Patent: Feb. 14, 2006

(54) COLOR CATHODE RAY TUBE

(75) Inventor: Yong-Kun Kim, Kyeongsangbuk-do (KR)

(73) Assignee: LG.Philips Display Korea Co., Ltd., Kyeongsangbuk-Do (KR)

( * ) Notice: Subject to any disclaimer, the term of this patent is extended or adjusted under 35 U.S.C. 154(b) by 198 days.

(21) Appl. No.: 10/728,912

(22) Filed: Dec. 8, 2003

(65) Prior Publication Data

US 2004/0164663 A1 Aug. 26, 2004

(30) Foreign Application Priority Data

Feb. 24, 2003 (KR) ..... 10-2003-0011394

(51) Int. Cl.
*H01J 29/80* (2006.01)

(52) U.S. Cl. ..... 313/402; 313/403; 313/407; 313/408

(58) Field of Classification Search ..... 313/402, 313/407, 408, 403–406
See application file for complete search history.

(56) References Cited

U.S. PATENT DOCUMENTS 4,623,818 A 11/1986 Yamazaki
5,155,410 A * 10/1992 Wakasono et al. ..... 313/402
6,448,706 B1 * 9/2002 Kawamura et al. ..... 313/477 R
6,593,685 B1 * 7/2003 Kim ..... 313/407
6,628,060 B1 * 9/2003 Shimizu et al. ..... 313/408
6,674,225 B1 * 1/2004 Jung ..... 313/402
6,879,094 B1 * 4/2005 Choi ..... 313/407
2001/0018309 A1 * 8/2001 Nishiki et al. ..... 445/30
2002/0195920 A1 * 12/2002 Furusawa et al. ..... 313/402

* cited by examiner

*Primary Examiner*—David V. Bruce
*Assistant Examiner*—Elizabeth Keaney
(74) *Attorney, Agent, or Firm*—McKenna Long & Aldridge LLP

(57) ABSTRACT

Disclosed is a color cathode ray tube which can effectively improve impact resistance by setting a ratio of a curvature coefficient (a/b) of the shadow mask for a long axis to be in a range of about 100,000–135,000, and by setting a ratio of a curvature coefficient (c/d) of the shadow mask for a short axis to be in a range of about 60,000–360,000. Also, in defining ratios between a curvature radius of a center portion of the shadow mask and curvature radiuses along a horizontal direction, a vertical direction, and a diagonal direction, the curvature radius decreases towards the peripheral portions of the shadow mask, thereby improving impact resistance and drop characteristics and thus effectively preventing color purity from being degraded.

36 Claims, 8 Drawing Sheets

COLOR CATHODE RAY TUBE

This application claims the benefit of Korean Patent Application No. 2003-11394, filed on Feb. 24, 2003, which is hereby incorporated by reference for all purposes as if fully set forth herein.

BACKGROUND OF THE INVENTION

1. Field of the Invention

The present invention relates to a color cathode ray tube, and more particularly, to a color cathode ray tube which can increase impact resistance by having an optimum curvature coefficient of a shadow mask.

2. Discussion of the Related Art

Generally, color cathode ray tubes are the most commonly used display devices, in which an electron beam emitted from an electron gun hits a fluorescent film in a vacuum state of high temperature to display images.

FIG. 1 is a side view showing an inside of a color cathode ray tube according to a related art, and FIG. 2 is a perspective view showing a shadow mask according to a related art.

Referring to FIG. 1, the cathode ray tube includes: a panel 1 having a fluorescent surface 1*a* and a face 1*b;* a shadow mask 3 for selecting a color of an electron beam emitted from an inside of the panel 1; a frame 4 for fixing the shadow mask 3; a stud pin 5 for fixing the frame 4 to the panel 1; a spring 6 for connecting the stud pin 5 to the frame 4; a funnel 7 engaged to a rear surface of the panel 1 for maintaining a vacuum state inside the cathode ray tube; a seal edge line 7*a* formed at a junction of the funnel 7 and the panel 1; a neck portion 8 formed behind the funnel 7; an electron gun 9 mounted to the neck portion 8 for emitting an electron beam; an inner shield 10 assembled to the frame 4 so as to shield the emitted electron beam from external magnetic fields; a deflection yoke 11 which surrounds an outer side of the funnel 7 for deflecting the electron beam; a reinforcing band 12 mounted at a skirt portion of the panel 1 for distributing stress and performing impact resistance; and a lug 13 for fixing the cathode ray tube. An axis of the cathode ray tube is labeled S.

Referring now to FIG. 2, the shadow mask 3 includes: an effective surface 3*a* on which circular or elliptical slots (not shown) are formed; and a skirt 3*b* having a constant height so as to be welded to the frame 4. The slots of the shadow mask 3 are arranged horizontally or vertically with a constant interval so that the electron beam can maintain a constant interval when the electron beam emitted from the electron gun passes through the slots and lands on the fluorescent film 1*a*.

In operation, the electron gun 9 emits thermo electrons in accordance with inputted image signals. The emitted thermo electrons move forward towards the panel 1 by a voltage applied from each electrode of the electron gun 9 through acceleration and focusing processes. At this time, the thermo electrons are deflected by the deflection yoke 11 and pass through the slots formed on the shadow mask 3, thereby making color selection possible. Then, the thermo electrons collide with the fluorescent film 1*a* located at an inner surface of the panel 1 such that the thermo electrons excite the corresponding portion of the fluorescent film 1*a*, thereby displaying an image.

However, if the shadow mask is deformed by an external impact, some of the electron beams from the electron gun land on the wrong place on the fluorescent film deviating from an original intended position, thereby degrading color purity.

Hereinafter, impact resistance characteristics of the shadow mask for the external impact will be explained with reference to FIGS. 3 and 4. FIG. 3 is a side view showing a drop effect of the shadow mask illustrated in FIG. 2, and FIG. 4 is a graph showing a deformation mechanism of the shadow mask illustrated in FIG. 2.

As shown in FIG. 3, if an external impact is applied to the shadow mask 3, a drop effect occurs at a center portion of the shadow mask 3. Also, if the external impact exceeds the limitation point of the shadow mask 3, a plastic deformation is generated around the shadow mask. The external impact applied to the shadow mask is transmitted more greatly to the vertical direction of the curved surface of the shadow mask 3 rather than to the lateral directions thereof, which results in the plastic deformation of the shadow mask 3.

As shown in FIG. 4, if the external impact is applied to the curved surface of the shadow mask 3, the shadow mask undergoes a deformation for a constant time in proportion to the external impact. If the external impact exceeds the limitation point of the shadow mask 3, the deformed portion of the shadow mask can not be restored to the original state, thereby degrading color purity.

In order to solve these problems, there has been efforts to change the material and the thickness of the shadow mask, to form beads in the shadow mask, or to change the welding position of the skirt in the shadow mask. An amount of drop in relation to an external impact can be expressed by formula 1, (E * thickness T)/(M). As shown in formula 1, the amount of drop in the shadow mask is proportional to the Young's modulus E and the thickness T, and is inversely proportional to the mass M. A shadow mask formed of material with a high Young's modulus or with an increased thickness in accordance with the above principle has, however, increased the manufacturing cost of the shadow mask. Also, the effort to form embossment beams on the shadow mask has affected formation of the curved surface, without improving impact resistance of the shadow mask. In addition, the effort to form the welding point to fix the skirt and the frame of the shadow mask are fixed, near the curved surface of the shadow mask to reduce the effects of an external impact has caused the shadow mask and the frame to expand by the electron beam such that it has worsened the doming effect in which the electron beam is displaced from its originally intended position on the fluorescent surface, thereby degrading color purity.

There has also been an effort to design the panel, which is the basis for forming the shadow mask or its curvature, with a curvature that decreases gradually from the center portion thereof. However, limitations exist in controlling the thickness and the curvature due to the limitations of the panel fabrication. That is, a wedge ratio, which corresponds to thickness ratio between the center portion of a panel and the corner portion, of a color cathode ray tube having a flat outer surface center does not exceed 200%. For cathode ray tubes having a flatter outer surface center, the effect on impact resistance by gradually decreasing curvature radius reduces substantially, and if the curvature radius is significantly decreased, impact resistance deteriorates due to the increase of flat areas in the center portion of the cathode ray tube.

SUMMARY OF THE INVENTION

Accordingly, the present invention is directed to a color cathode ray tube that substantially obviates one or more of the problems due to limitations and disadvantages of the related art.

An advantage of the present invention is to provide a color cathode ray tube which can effectively prevent color purity degradation by improving impact resistance and drop characteristic of a shadow mask, in which the curvature coefficient ratio, which relates to a long axis and a short axis in the formula of the shadow mask, is limited, or in which a ratio between a curvature radius of a center portion and a curvature radius of a specific position of the shadow mask is fixed at a predetermined value.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, the present invention provides a color cathode ray tube comprising: a panel installed at a front surface of the cathode ray tube; a shadow mask for selecting a color of an electron beam emitted from inside of the panel; a funnel engaged to a rear surface of the panel for maintaining a vacuum state inside the cathode ray tube; a deflection yoke surrounding an outer side of the funnel for deflecting the electron beam; and an electron gun formed behind the funnel, wherein a curvature coefficient (a/b) of the shadow mask is in a range of about 70,000–200,000, where the curvature formula of the shadow mask is defined as a polynomial of $Z(X,Y)=aX^2+bX^4+cY^2+dY^4$, and where X and Y are defined as arbitrary coordinate points of a horizontal axis (long axis) and a vertical axis (short axis).

In another aspect of the present invention, a color cathode ray tube comprises: a panel installed at a front surface of the cathode ray tube; a shadow mask for selecting a color of an electron beam emitted from inside of the panel; a funnel engaged to a rear surface of the panel for maintaining a vacuum state inside the cathode ray tube; a deflection yoke surrounding an outer side of the funnel for deflecting the electron beam; and an electron gun formed behind the funnel, wherein a curvature coefficient (c/d) of the shadow mask is in a range of about 60,000–360,000, where the curvature formula of the shadow mask is defined as a polynomial of $Z(X, Y)=aX^2+bX^4+cY^2+dY^4$, and where X and Y are defined as arbitrary coordinate points of a horizontal axis (long axis) and a vertical axis (short axis).

In another aspect of the present invention, a color cathode ray tube comprises: a panel installed at a front surface of the cathode ray tube; a shadow mask for selecting a color of an electron beam emitted from inside of the panel; a funnel engaged to a rear surface of the panel for maintaining a vacuum state inside the cathode ray tube; a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of an effective distance along a horizontal axis (long axis) from the center portion is decreased by more than 35%, a curvature radius at a position corresponding to 80% of an effective distance along a vertical axis (short axis) from the center portion is decreased by more than 50%, and a curvature radius at a position corresponding to 80% of an effective distance along a diagonal axis from the center portion is decreased by more than 25%, with reference to the curvature radius of the center portion of the shadow mask.

In another aspect of the present invention, the preferred embodiment of the present invention provides a color cathode ray tube comprising: a panel installed at a front surface of the cathode ray tube; a shadow mask for selecting a color of an electron beam emitted from an inside of the panel; a funnel engaged to a rear surface of the panel for maintaining a vacuum state inside the cathode ray tube; a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at an end portion of an effective surface of the shadow mask along a horizontal axis from the center portion is decreased by more than 40%, a curvature radius at an end portion of the effective surface of the shadow mask along a vertical axis from the center portion is decreased by more than 50%, and a curvature radius at an end portion of the effective surface of the shadow mask along a diagonal axis from the center portion is decreased by more than 50%, with reference to the curvature radius of the center portion of the shadow mask.

In yet another aspect of the present invention, a color cathode ray tube comprises: a panel installed at a front surface of the cathode ray tube; a shadow mask for selecting a color of an electron beam emitted from inside of the panel; a funnel engaged to a rear surface of the panel for maintaining a vacuum state inside the cathode ray tube; a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of an effective distance along a horizontal axis (long axis) from the center portion is decreased by 35–55%, and a curvature radius at an end portion of an effective surface of the shadow mask along the horizontal direction from the center portion is decreased by 40–70%, with reference to the curvature radius of the center portion of the shadow mask.

A curvature radius at a position corresponding to 80% of the effective distance along a vertical axis from the center portion is decreased by 50–90%.

A curvature radius at a position corresponding to 80% of the effective distance along a diagonal axis from the center portion is decreased by 25–50%, and a curvature radius at an end portion of the effective surface of the shadow mask along the diagonal axis from the center portion is decreased by 50–90%.

In still another aspect of the present invention, a color cathode ray tube comprises: a panel installed at a front surface of the cathode ray tube; a shadow mask for selecting a color of an electron beam emitted from inside of the panel; a funnel engaged to a rear surface of the panel for maintaining a vacuum state inside the cathode ray tube; a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of an effective distance along a vertical axis from the center portion is decreased by 50–90%, with reference to the curvature radius of the center portion of the shadow mask.

A curvature radius of an outer surface of the panel is in a range of 30,000–100,000 mm.

A curvature radius of an inner surface of the panel is in a range of 1.5R–4.0R (R=a diagonal length of the effective surface of the shadow mask * 1.767, hereinafter the signal * denotes multiply).

A wedge ratio of the panel is in a range of 170–230% (wedge ratio=thickness of a corner of the panel/thickness of a center portion of the panel).

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to an embodiment of the present invention, examples of which are illustrated in the accompanying drawings.

Figure 1:
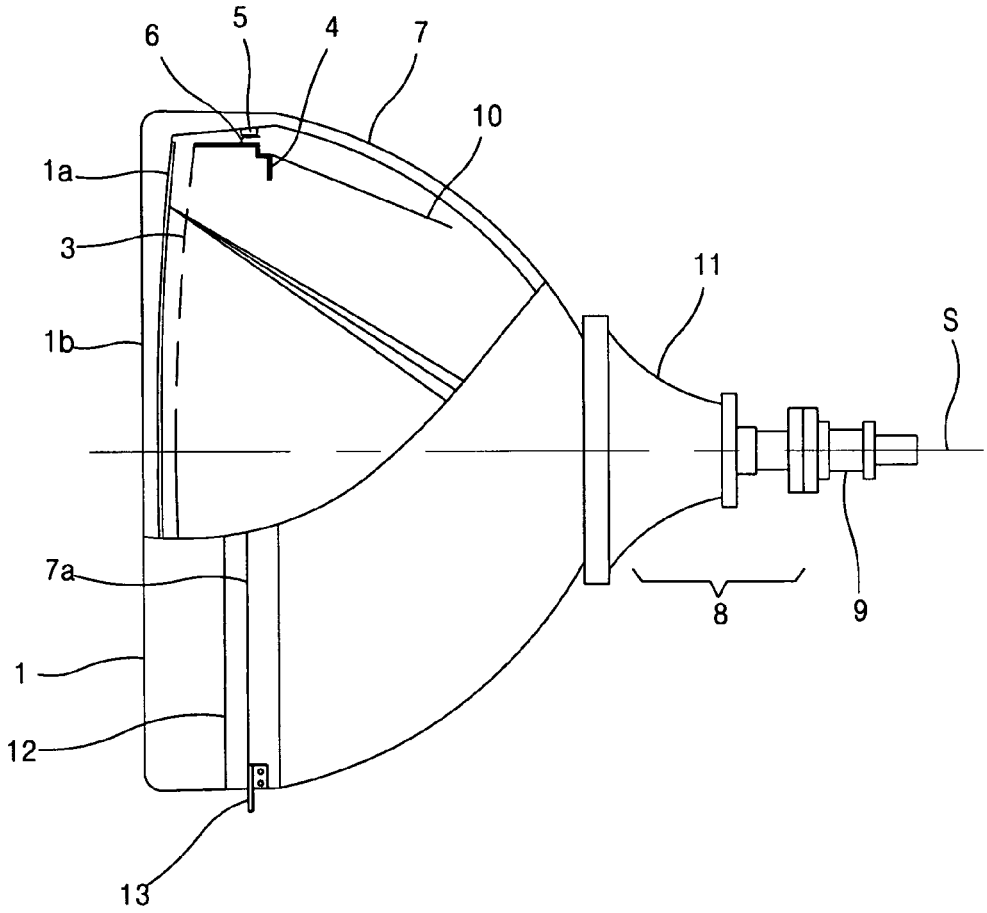
FIG. 1 RELATED ART
FIG. 1 is a side view showing an inside of a color cathode ray tube according to a related art.
Figure 2:
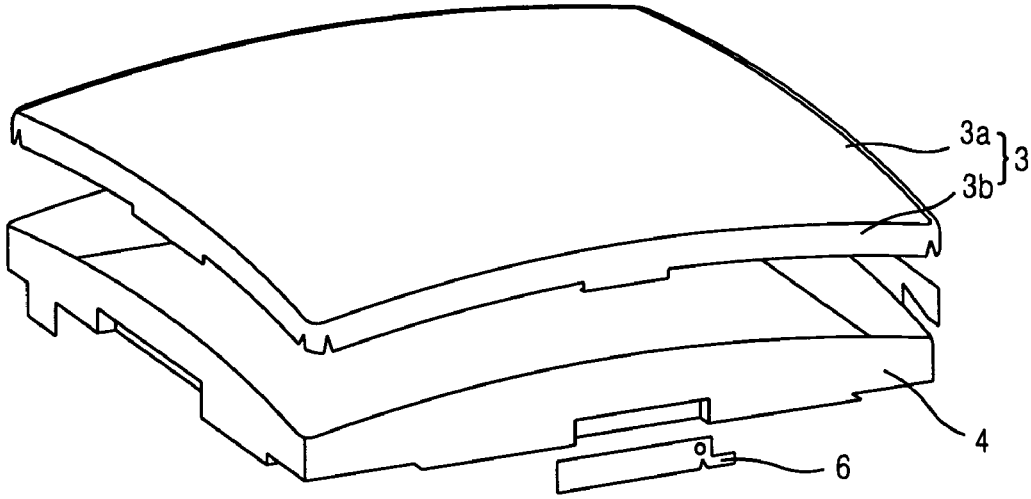
FIG. 2 RELATED ART
FIG. 2 is a perspective view showing a shadow mask according to a related art.
Figure 3:
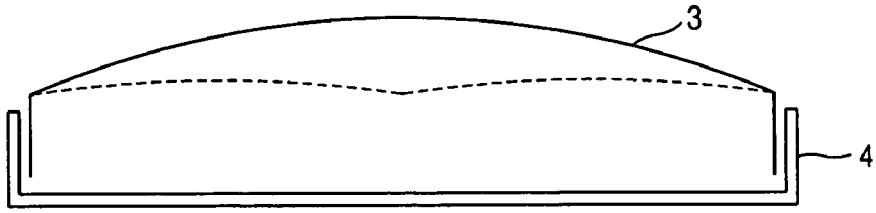
FIG. 3 RELATED ART
FIG. 3 is a side view showing a drop effect of the shadow mask illustrated in FIG. 2.
Figure 4:
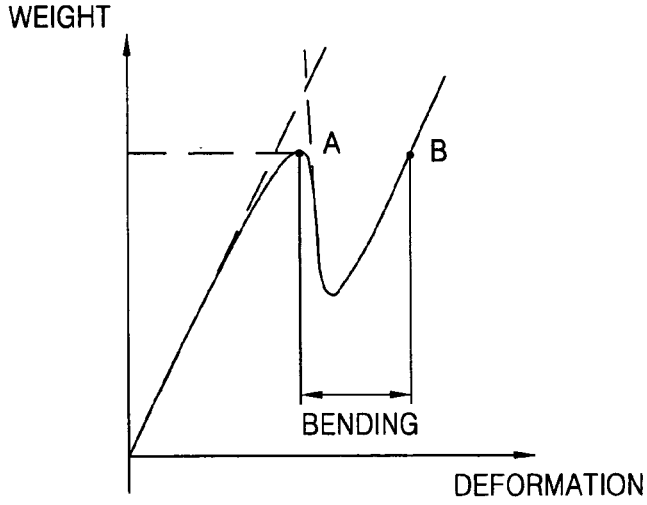
FIG. 4 RELATED ART
FIG. 4 is a graph showing a deformation mechanism of the shadow mask illustrated in FIG. 2 in response to an external impact.
Figure 5:
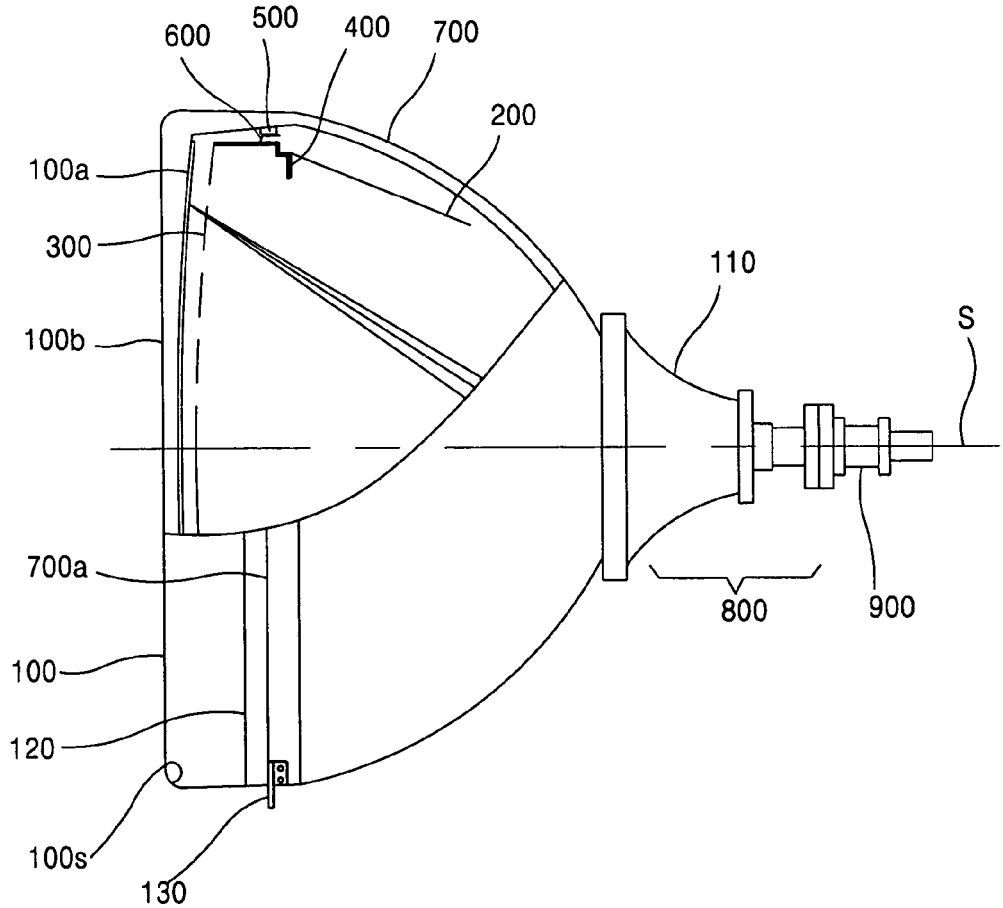
FIG. 5 is a side view showing an inside of a color cathode ray tube according to the present invention.

FIG. 5 is a side view showing inside of a color cathode ray tube according to the present invention. As shown, the color cathode ray tube according to the present invention includes: a panel 100 having a fluorescent surface 100*a* and a face 100*b;* a shadow mask 300 for selecting a color of an electron beam emitted from an inside of the panel 100; a frame 400 for fixing the shadow mask 300; a stud pin 500 for fixing the frame 400 to the panel 100; a spring 600 for connecting the stud pin 500 to the frame 400; a funnel 700 engaged to a rear surface of the flat panel 100 for maintaining a vacuum state inside the cathode ray tube; a seal edge line 700*a* formed at a junction of the funnel 700 and the panel 100; a neck portion 800 formed behind the funnel 700; an electron gun 900 mounted in the neck portion 800 for emitting an electron beam; an inner shield 200 assembled to the frame 400 so as to shield the emitted electron beam from external magnetic fields; a deflection yoke 110 which surrounds an outer side of the funnel 700 for deflecting the electron beam; a reinforcing band 120 mounted at a skirt portion 100S of the panel 100 for distributing stress and performing impact resistance; and a lug 130 for fixing the cathode ray tube. A code S denotes an axis of the cathode ray tube.

Figure 6:
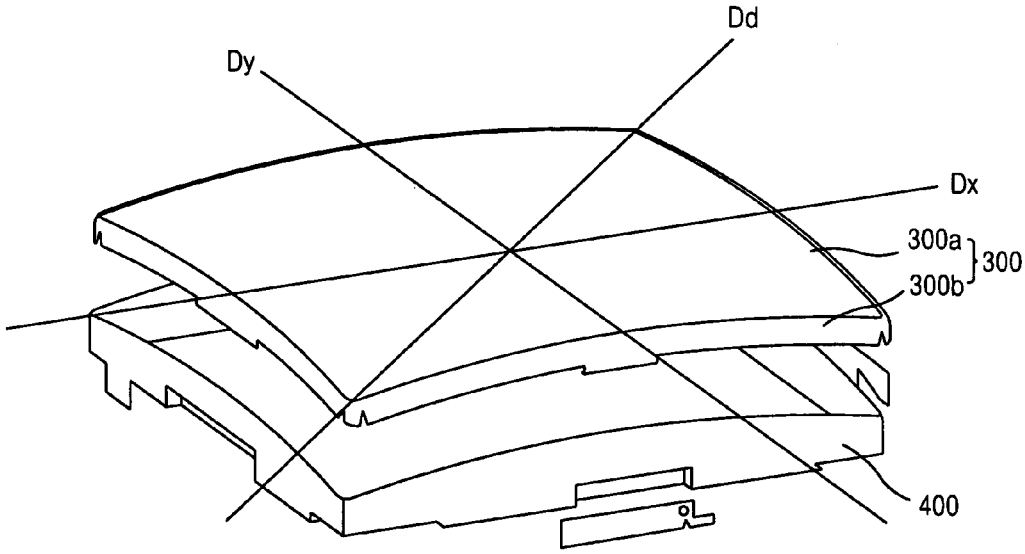
FIG. 6 is a perspective view showing a shadow mask according to the present invention.

FIG. 6 is a perspective view showing a shadow mask according to the present invention. As shown, the shadow mask 300 of the present invention includes: an effective surface 300*a* on which circular or elliptical slots (not shown) are formed; and a skirt 300*b* having a constant height so as to be welded to the frame 400. In order to explain a curvature radius of the shadow mask 300 of the present invention, a horizontal axis (long axis) of the shadow mask is referred to as Dx, a vertical axis (short axis) is referred to as Dy, and a diagonal axis is referred to as Dd.

In the present invention, shadow mask having an optimum curvature in order to solve the color purity degradation problem, which occurs when an electron beam mis-lands on a fluorescent film deviating from its originally intended position due to a plastically deformed shadow mask, which is in turn caused by an external impact.

The shadow mask generally has a following curvature formula, which influences impact resistance the most:

$$Z(X, Y)=aX^2+bX^4+cY^2+dY^4+eX^2Y^2+fX^4Y^2+gX^2Y^4+hX^4Y^4$$

where X and Y are defined as arbitrary coordinate points of a horizontal axis (long axis) and a vertical axis (short axis).

Even though the above curvature formula is a polynomial including a sixth degree term, part of the curvature formula with terms more than sixth degree has little influence on the curvature of a color cathode ray tube for a monitor. Thus, the curvature formula is, in general, expressed by a polynomial with terms less than or equal to the fourth degree. Hereinafter, only a, b, c, and d corresponding to coefficients of the fourth degree terms or below the fourth degree term will be explained.

As we can see from the curvature formula, the 'a' of the second degree term and the 'b' of the fourth degree term denote coefficients of a curvature radius of a horizontal axis, and the 'c' of the second degree term and the 'd' of the fourth degree term denote coefficients of a curvature radius of a vertical axis. In the $X^2$ and $X^4$ terms which determine a curvature of the long axis of the shadow mask, the coefficient 'a' of the second degree term is a value which defines a representative curvature, and becomes a coefficient of a single curvature R when the coefficient of the fourth degree term is '0'.

Herein, if the single curvature radius is assumed to be 'r', the curvature formula is expressed as $Z=r-r[1-(x/r)^2]^{(1/2)}$.

Herein, since x<r (r is much larger than x), $z=r-r\,[1-1/2(x/r)^2-(1/8)\,(x/r)^4+\ldots]=1/2(x/r)^2$.

In this curvature formula, if x=r, the curvature $z=(1/2)(x/r)^2$. This means that the coefficient of the second degree term has a single curvature radius, and that, when b approaches 0, a/b increases, with a and b being the coefficients of the horizontal axis (long axis) in the curvature formula, meaning that it becomes closer to a spherical type having a unitary radius.

Figure 7:
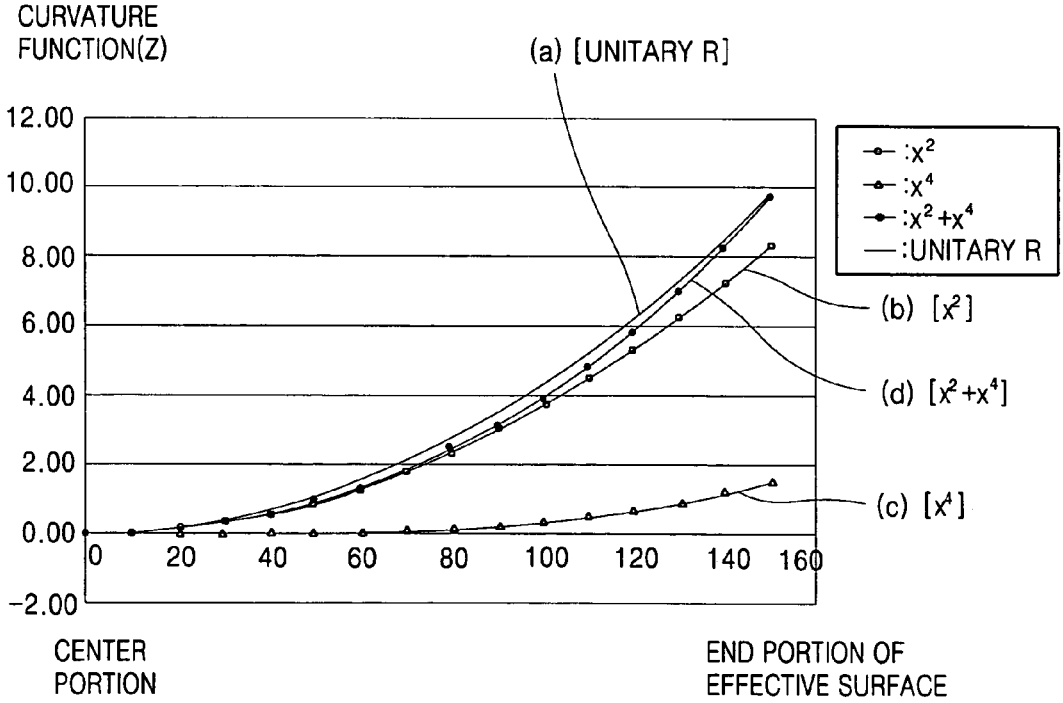
FIG. 7 is a graph showing a curvature according to a coefficient of a curvature formula.

FIG. 7 is a graph showing a curvature according to the coefficients of the curvature formula. As shown, the vertical axis denotes a distance from a center portion of the shadow mask to an end portion of the effective surface, and the horizontal axis denotes a curvature function Z. The curved line (a) (single curvature R) shows that the curvature of the shadow mask is a single curvature. The curved line (b) is a curvature function Z for the curvature coefficient 'a' of the second degree term of the x, and shows that the curvature of the shadow mask is a spherical form. The curved line (c) is a curvature function Z for the coefficient 'b' of the fourth degree term of the x, and shows a curvature form of the shadow mask, in which the center portion of the shadow mask is flat and z increases towards the end portion of the effective surface. The curved line (d) is a combination of the curved line (b) and the curved line (c) (the coefficient 'a' of the second degree term of the x and the coefficient 'b' of the fourth degree term of x), and as compared with the curved line (a) having a unitary curvature, the curved line (d) has different curvatures at the same Z value.

As shown in the above graph, the curved lines (b) and (c) do not have an improved drop characteristic, but the curved line (d), the combination of the curved lines (b) and (c), can improve the drop characteristic according to the coefficient 'a' of the second degree term of x and the coefficient 'b' of the fourth degree term of x.

Figure 8:
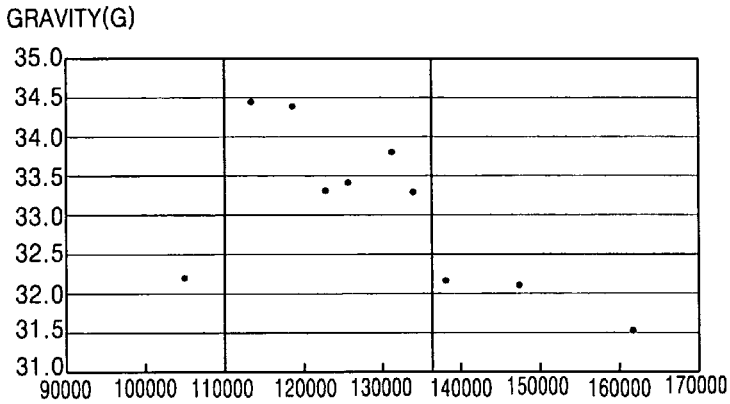
FIG. 8 is a view showing an interpretation of impact resistance according to a/b of the curvature formula.

FIG. 8 is a view showing an interpretation of impact resistance according to the a/b of the curvature formula. As shown, the horizontal axis denotes a ratio of the coefficient "a" of the second degree term of x for the coefficient of "b" of the fourth degree term (a/b), and the vertical axis shows a drop characteristic for gravitation G. Referring to FIG. 8, when only data more than 33G are considered, a/b had an improved drop characteristic in a range of 100,000–135,000. For reference, the drop characteristic of 33G means that the shadow mask does not get deformed by force corresponding to 33 times the force of gravity, and drop characteristic improves towards the upper direction in the graph.

Figure 9:
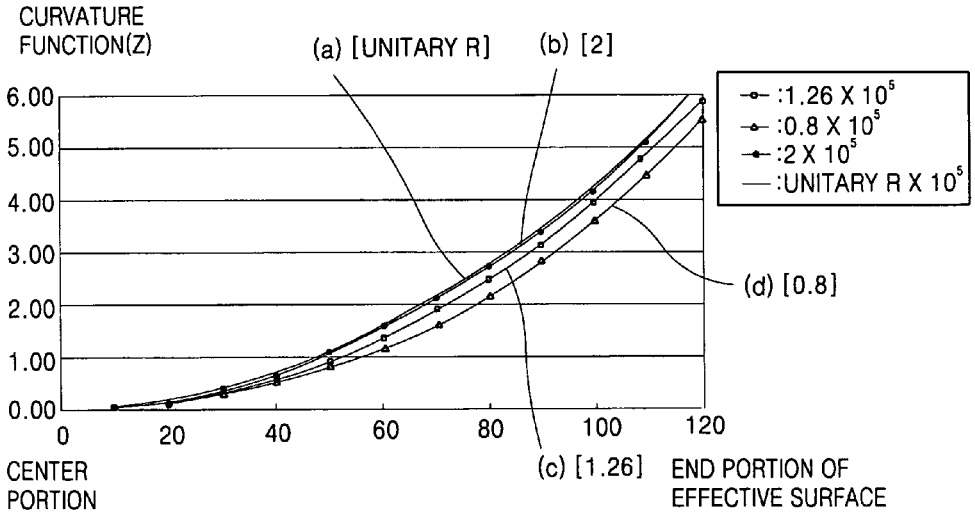
FIG. 9 is a view showing a curvature form according to a/b of the curvature formula.

FIG. 9 shows a curvature according to the ratio of the curvature a/b. As shown, the vertical axis denotes a distance from the center portion of the shadow mask to the end portion of the effective surface, and the horizontal axis denotes the curvature function Z. The curved line (a) is a single curvature R, the curved line (b) is a curved line having the a/b of 2*E5, the curved line (c) is a curved line having the a/b of 1.26*E5, and the curved line (d) is a curved line having the a/b of 0.8*E5. As shown in FIG. 9, the curved line (c) shows the optimum drop characteristic in the section of 1.0*E5–1.35*E5. The curved line (d) having the a/b of 0.8*E5, which is not located at the section of 1.0*E5–1.35*E5, makes the center portion of the shadow mask flatter and weakens rigidity as compared with the optimum curved line (c). Also, the curved line (b) having the a/b more than 1.35*E5 is a curvature similar to a spherical curvature, so that the impact resistance is degraded.

As explained above, it is desirable that the curvature coefficient a/b of the shadow mask is in a range of 70,000–200,000, and it is more desirable that the curvature coefficient a/b of the shadow mask is in a range of 100,000–135,000. If the principle applied to the a/b is applied to the (c/d), it is desirable that the curvature coefficient (c/d) of the shadow mask is in a range of 60,000–300,000, and it is more desirable that the curvature coefficient (c/d) of the shadow mask is in a range of 200,000–300,000.

In the meantime, it is also desirable that an outer surface curvature radius is in a range of 30,000–100,000 mm. An outer surface curvature radius of the horizontal axis of the panel is beneficially in a range of 25,000–80,000 m/m, and an outer surface curvature radius of the vertical axis of the panel is beneficially in a range of 50,000–100,000 mm.

The present invention is characterized in that an inner surface curvature radius of the panel is in a range of 1.5R-4.0, where R=a diagonal length of the effective surface of the shadow mask * 1.767. The present invention is also characterized in that a wedge ratio of the panel is in a range of 170–230%, where wedge ratio=thickness of the corner portion of the panel/thickness of the center portion of the panel. Also, the shadow mask to which the present invention is applied is used not only for televisions but also for monitors.

Hereinafter, ratios between a curvature radius of the center portion of the shadow mask according to the present invention and curvature radiuses according to the horizontal axis (long axis), the vertical axis (short axis), and the diagonal axis will be explained with reference to FIGS. 10 to 14. FIGS. 10 to 14 are views for explaining ratios between a curvature radius at a center portion of the shadow mask according to the present invention and curvature radiuses at a point corresponding to 80% of the effective distance and at the end portion of the effective surface according to a horizontal axis, a vertical axis, and a diagonal axis.

Generally, the effective distance means a distance between end portions of a diagonal line of the effective surface. However, since both sides are symmetrical with respect to the center of the shadow mask, the distance between the center portion and the end portion of the effective surface will be defined as the effective distance L1.

Figure 10:
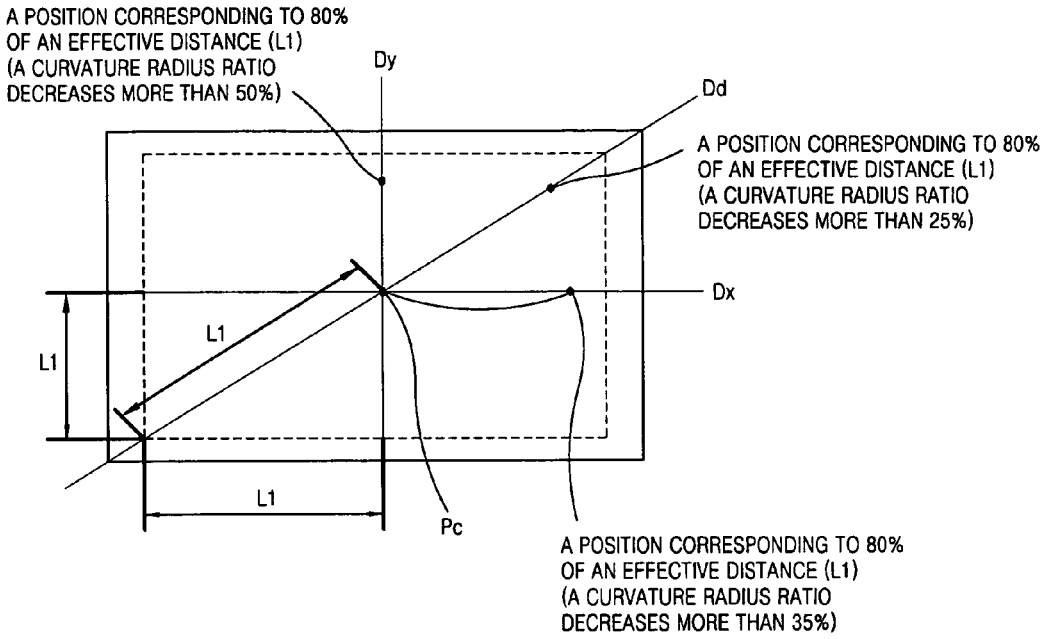
FIGS. 10 to 14 are views for explaining ratios between a curvature radius at a center portion of the shadow mask according to the present invention and curvature radiuses at a point corresponding to 80% of an effective distance and at an end portion of an effective surface according to a horizontal axis, a vertical axis, and a diagonal axis.

The shadow mask of the present invention has the curvature radius gradually decreasing from the center portion toward the peripheral portion. As shown in FIG. 10, in the first preferred embodiment of the present invention, a curvature radius at a position corresponding to 80% of the effective distance along the horizontal axis (the long axis) from the center portion is decreased by more than 35%, a curvature radius at a position corresponding to 80% of the effective distance along the vertical axis (the short axis) from the center portion is decreased by more than 50%, and a curvature radius at a position corresponding to 80% of the effective distance along the diagonal axis from the center portion is decreased by more than 25%, with reference to the curvature radius of the center portion of the shadow mask 300.

Figure 11:
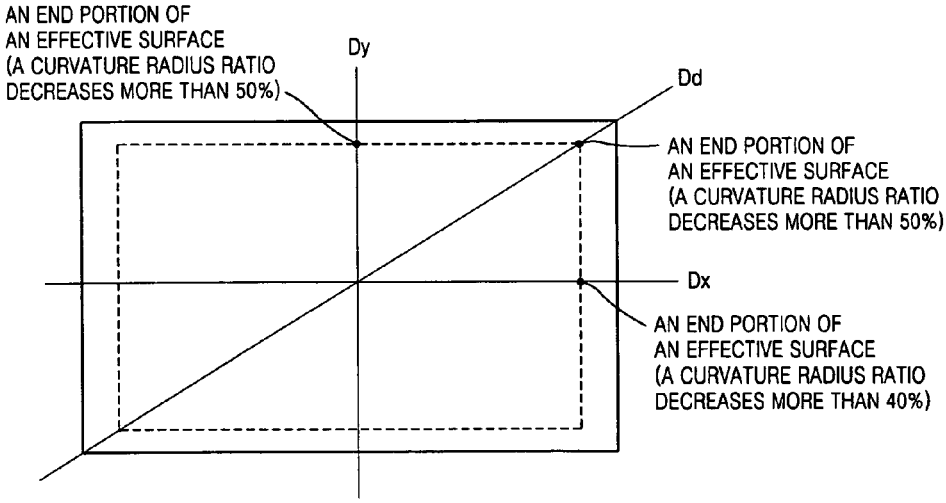

Also, as shown in FIG. 11, in the second embodiment of the present invention, the curvature radius at the end portion of the effective surface of the shadow mask along the horizontal axis from the center portion is decreased by more than 40%, a curvature radius at the end portion of the effective surface of the shadow mask along the vertical axis from the center portion is decreased by more than 50%, and a curvature radius at the end portion of the effective surface of the shadow mask along the diagonal axis from the center portion is decreased by more than 50%, with reference to the curvature radius of the center portion of the shadow mask.

Figure 12:
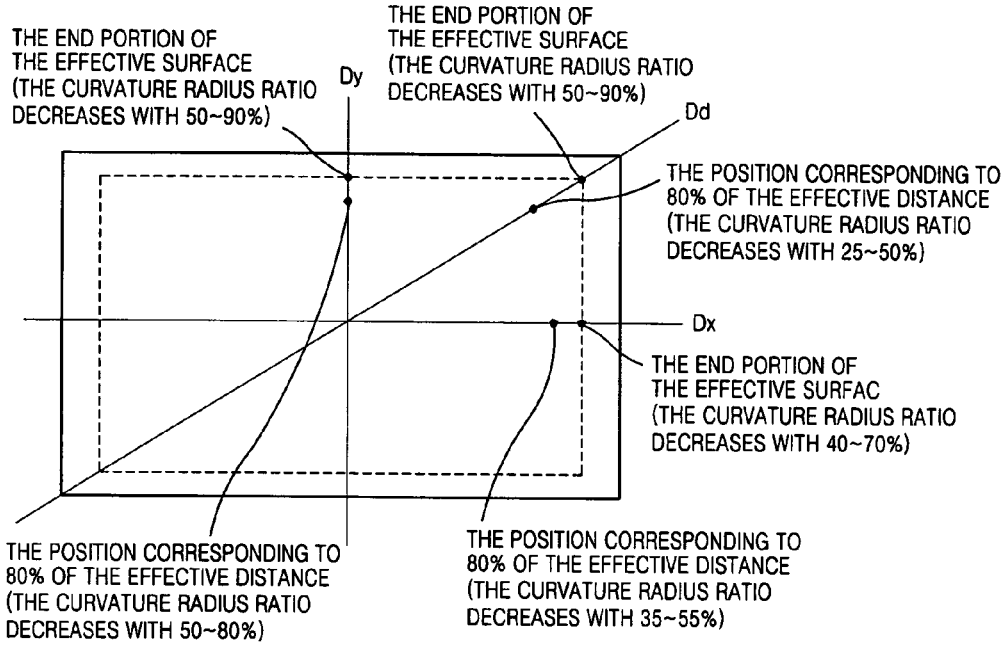

Also, as shown in FIG. 12, in the third preferred embodiment of the present invention, a curvature radius at a position corresponding to 80% of the effective distance along the horizontal axis from the center portion is decreased by 35–55%, and a curvature radius at an end portion of the effective surface of the shadow mask along the horizontal direction from the center portion is decreased by 40–70%, a curvature radius at a position corresponding to 80% of the effective distance along the vertical axis from the center portion is decreased by 50–80%, a curvature radius at the end portion of the effective surface of the shadow mask along the vertical axis from the center portion is decreased by 50–90%, a curvature radius at a position corresponding to 80% of the effective distance along the diagonal axis from the center portion is decreased by 25–50%, and a curvature radius at the end portion of the effective surface of the shadow mask along the diagonal axis from the center portion is decreased by 50–90%, with reference to the curvature radius of the center portion of the shadow mask.

Figure 13:
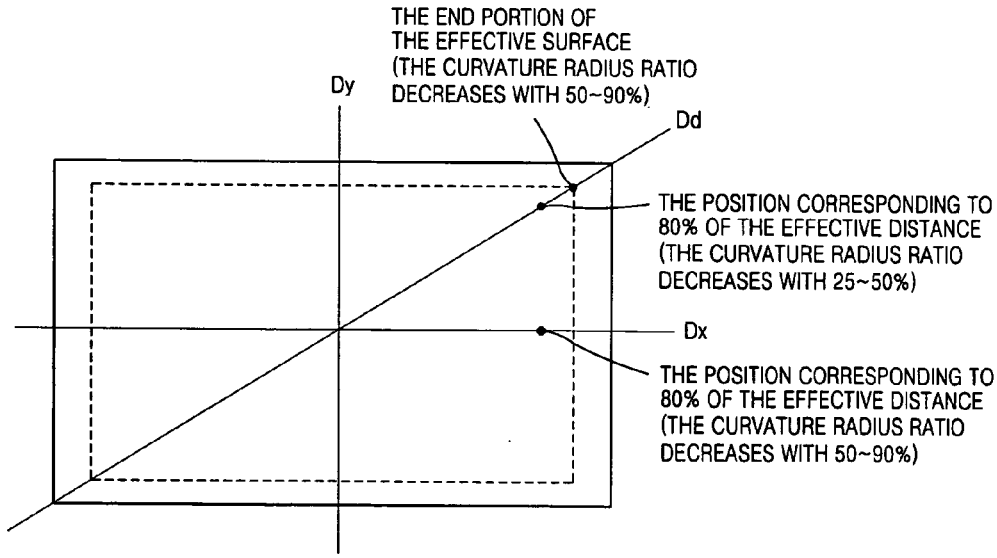

Also, as shown in FIG. 13, in the fourth embodiment of the present invention, the curvature radius at a position corresponding to 80% of the effective distance along the horizontal axis Dx from the center portion is decreased by 50–90%, a curvature radius at a position corresponding to 80% of the effective distance along the diagonal axis from the center portion is decreased by 25–50%, and a curvature radius at the end portion of the effective surface of the shadow mask along the diagonal axis from the center portion is decreased by 50–90%, with reference to the curvature radius of the center portion of the shadow mask.

Figure 14:
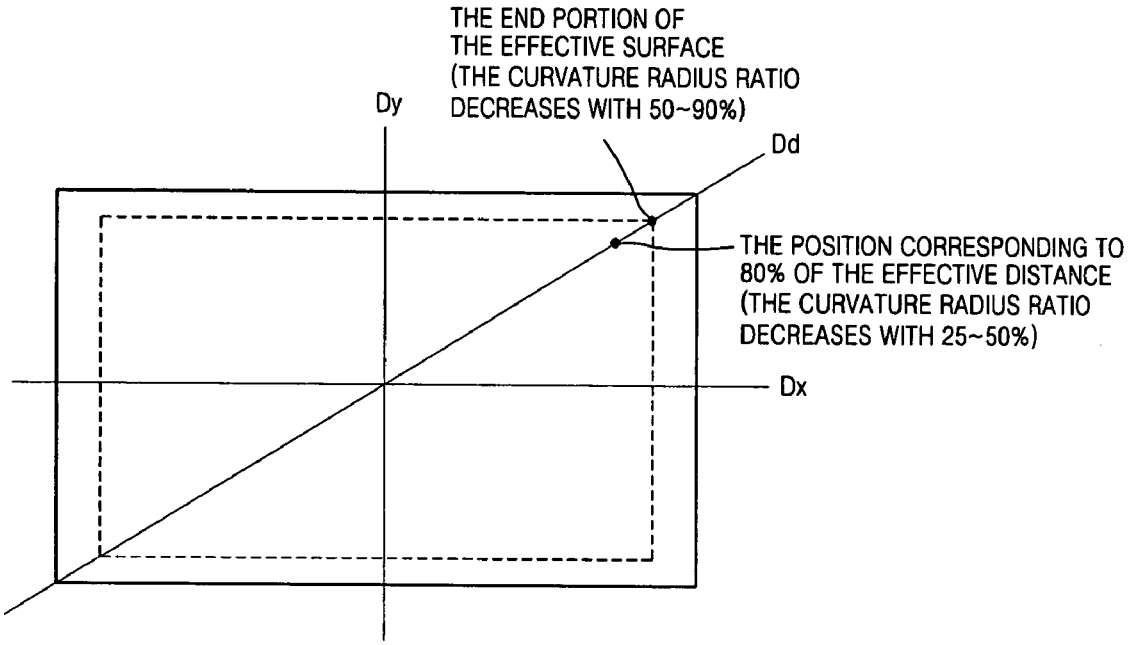

As shown in FIG. 14, in the fifth embodiment of the present invention, the curvature radius of the shadow mask decreases from the center portion of the shadow mask towards the peripheral portions, and a curvature radius at a position corresponding to 80% of the effective distance along the diagonal axis from the center portion is decreased by 25–50%, and the curvature radius at an end portion of the effective surface of the shadow mask along the diagonal axis from the center portion is decreased by 50–90%, with reference to the curvature radius of the center portion of the shadow mask.

An outer surface of the funnel to which the deflection yoke is mounted is a non-circle shape having a maximum diameter in a direction except the horizontal direction and the vertical direction. Recently, an RAC type funnel, which decreases the deflection electric power of a cathode ray tube by minimizing the distance between the deflection yoke and the funnel, thereby enhancing deflection force, is being presented. The shape of at least the outer surface among the inner and outer surfaces has to be changed from a circle type into a non-circle type having a maximum diameter in a direction except the horizontal direction and the vertical direction towards the panel direction from the electron gun direction. According to this, a sectional surface of the deflection yoke is also constructed as a non-circle shape. Therefore, the present invention can be applied to a cathode ray tube having the RAC type funnel, and has the same effects on those cathode ray tubes.

As aforementioned, in the present invention, a ratio of the curvature coefficient (a/b) of the shadow mask for the long axis is set to be in a range of 100,000–135,000 and a ratio of the curature coefficient (c/d) of the shadow mask for the short axis is set to be in a range of 60,000–360,000. Also, the present invention is characterized in that, in defining ratios between the curvature radius of the center portion of the shadow mask and curvature radiuses along the horizontal direction, the vertical direction, and the diagonal direction, the curvature radius decreases specifically towards the peripheral portions of the shadow mask, thereby improving impact resistance and drop characteristic and thus effectively preventing color purity from being degraded.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein a curvature coefficient (a/b) of the shadow mask is in a range of about 70,000–200,000, where a curvature formula of the shadow mask is defined as a polynomial of $Z(X,Y)=aX^2+bX^4+cY^2+dY^4+eX^2Y^2+fX^4Y^2+gX^2Y^4$, and where X and Y are defined as arbitrary coordinate points of a horizontal axis (long axis) and a vertical axis (short axis).

2. The color cathode ray tube of claim 1, wherein the curvature coefficient (a/b) of the shadow mask is in a range of about 100,000–135,000.

3. The color cathode ray tube of claim 1, wherein the curvature coefficient (c/d) of the shadow mask is in a range of about 60,000–360,000.

4. The color cathode ray tube of claim 1, wherein a curvature radius of an outer surface of the panel is in a range of about 30,000–100,000 m/m.

5. The color cathode ray tube of claim 4, wherein an outer surface curvature radius of a horizontal axis of the panel is in a range of about 25,000–80,000 m/m and an outer surface curvature radius of a vertical axis of the panel is in a range of about 50,000–100,000 m/m.

6. The color cathode ray tube of claim 1, wherein a curvature radius of an inner surface of the panel is in a range of about 1.5R–4.0R, where R=a diagonal length of an effective surface of the shadow mask*1.767.

7. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein a curvature coefficient (c/d) of the shadow mask is in a range of about 60,000–360,000, where curvature formula of the shadow mask is defined as a polynomial of $Z(X,Y)=aX^2+bX^4+cY^2+dY^4+eX^2Y^2+fX^4Y^2+gX^2Y^4+hX^4Y^4$, and where X and Y are defined as arbitrary coordinate points of a horizontal axis (long axis) and a vertical axis (short axis).

8. The color cathode ray tube of claim 7, wherein the curvature coefficient (c/d) of the shadow mask is in a range of about 200,000–300,000.

9. The color cathode ray tube of claim 7, wherein the curvature coefficient (a/b) of the shadow mask is in a range of about 70,000–200,000.

10. The color cathode ray tube of claim 7, wherein the curvature coefficient (a/b) of the shadow mask is in a range of about 100,000–135,000.

11. The color cathode ray tube of claim 7, wherein a curvature radius of an outer surface of the panel is in a range of about 30,000–100,000 m/m.

12. The color cathode ray tube of claim 11, wherein an outer surface curvature radius of a horizontal axis of the panel is in a range of about 25,000–80,000 m/m and an outer surface curvature radius of a vertical axis of the panel is in a range of about 50,000–100,000 m/m.

13. The color cathode ray tube of claim 7, wherein a curvature radius of an inner surface of the panel is in a range of about 1.5R–4.0R, where R=a diagonal length of an effective surface of the shadow mask*1.767.

14. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of an effective distance along a horizontal axis (long axis) from the center portion is decreased by more than 35%, a curvature radius at a position corresponding to 80% of an effective distance along a vertical axis (short axis) from the center portion is decreased by more than 50%, and a curvature radius at a position corresponding to 80% of an effective distance along a diagonal axis from the center portion is decreased by more than 25%, with reference to the curvature radius of the center portion of the shadow mask.

15. The color cathode ray tube of claim 14, wherein a curvature radius of an outer surface of the panel is in a range of about 30,000–100,000 m/m.

16. The color cathode ray tube of claim 15, wherein an outer surface curvature radius of a horizontal axis of the panel is in a range of about 25,000–80,000 m/m and an outer surface curvature radius of a vertical axis of the panel is in a range of about 50,000–100,000 m/m.

17. The color cathode ray tube of claim 14, wherein a curvature radius of an inner surface of the panel is in a range of about 1.5R–4.0R, where R=a diagonal length of an effective surface of the shadow mask*1.767.

18. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at an end portion of an effective surface of the shadow mask along a horizontal axis from the center portion is decreased by more than 40%, a curvature radius at an end portion of the effective surface of the shadow mask along a vertical axis from the center portion is decreased by more than 50%, and a curvature radius at an end portion of the effective surface of the shadow mask along a diagonal axis from the center portion is decreased by more than 50%, with reference to the curvature radius of the center portion of the shadow mask.

19. The color cathode ray tube of claim 18, wherein a curvature radius of an outer surface of the panel is in a range of 30,000–100,000 m/m.

20. The color cathode ray tube of claim 19, wherein an outer surface curvature radius of a horizontal axis of the panel is in a range of about 25,000–80,000 m/m and an outer surface curvature radius of a vertical axis of the panel is in a range of about 50,000–100,000 m/m.

21. The color cathode ray tube of claim 18, wherein a curvature radius of an inner surface of the panel is in a range of about 1.5R–4.0R, where R=a diagonal length of an effective surface of the shadow mask*1.767.

22. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of an effective distance along a horizontal axis (long axis) from the center portion is decreased by about 35–55%, and a curvature radius at an end portion of an effective surface of the shadow mask along the horizontal direction from the center portion is decreased by about 40–70%, with reference to the curvature radius of the center portion of the shadow mask.

23. The color cathode ray tube of claim 22, wherein a curvature radius at a position corresponding to 80% of the effective distance along a vertical axis from the center portion is decreased by about 50–90%.

24. The color cathode ray tube of claim 22, wherein a curvature radius located at a position corresponding to 80% of the effective distance along a diagonal axis from the center portion is decreased by about 25–50%, and a curvature radius at an end portion of the effective surface of the shadow mask along the diagonal axis from the center portion is decreased by about 50–90%.

25. The color cathode ray tube of claim 22 wherein a curvature radius of an outer surface of the panel is in a range of about 30,000–100,000 m/m.

26. The color cathode ray tube of claim 25, wherein an outer surface curvature radius of a horizontal axis of the panel is in a range of about 25,000–80,000 m/m and an outer surface curvature radius of a vertical axis of the panel is in a range of about 50,000–100,000 m/m.

27. The color cathode ray tube of claim 22, wherein a curvature radius of an inner surface of the panel is in a range of about 1.5R–4.0R, where R=a diagonal length of an effective surface of the shadow mask*1.767.

28. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of an effective distance along a vertical axis from the center portion is decreased by about 50–90%, with reference to the curvature radius of the center portion of the shadow mask.

29. The color cathode ray tube of claim 28, wherein a curvature radius at a position corresponding to 80% of the effective distance along a diagonal axis from the center portion is decreased by about 25–50%, and a curvature radius at an end portion of the effective surface of the shadow mask along the diagonal axis from the center portion is decreased by about 50–90%.

30. The color cathode ray tube of claim 28, wherein a curvature radius of an outer surface of the panel is in a range of about 30,000–100,000 m/m.

31. The color cathode ray tube of claim 30, wherein an outer surface curvature radius of a horizontal axis of the panel is in a range of about 25,000–80,000 m/m and an outer surface curvature radius of a vertical axis of the panel is in a range of about 50,000–100,000 m/m.

32. The color cathode ray tube of claim 28, wherein a curvature radius of an inner surface of the panel is in a range of about 1.5R–4.0R, where R=a diagonal length of an effective surface of the shadow mask*1.767.

33. The color cathode ray tube of claim 1, wherein a wedge ratio of the panel is in a range of about 170–230%, where wedge ratio=thickness of a corner of the panel/thickness of a center portion of the panel.

34. The color cathode ray tube of claim 1, wherein the panel and the shadow mask are used for a monitor.

35. A color cathode ray tube comprising:

a panel installed at a front surface of the cathode ray tube;

a shadow mask for selecting a color of an electron beam emitted from an inside of the panel;

a funnel engaged to a rear surface of the panel for maintaining a vacuum state inside the cathode ray tube;

a deflection yoke surrounding an outer side of the funnel for deflecting the electron beam; and an electron gun formed behind the funnel, wherein the shadow mask has a curvature radius gradually decreasing towards a peripheral portion of the shadow mask from a center portion thereof, and wherein a curvature radius at a position corresponding to 80% of the effective distance along the diagonal axis from the center portion is decreased by about 25–50%, and a curvature radius at an end portion of the effective surface of the shadow mask along the diagonal axis from the center portion is decreased by about 50–90%, with reference to the curvature radius of the center portion of the shadow mask.

36. The color cathode ray tube of claim 1, wherein an outer surface of the funnel to which the deflection yoke is mounted is a non-circle shape having a maximum diameter in a direction except the horizontal direction and the vertical direction.

* * * * *